United States Patent [19]

Fegley et al.

[11] 3,963,145

[45]*June 15, 1976

[54] ANTI-BURGLARY CHEMICAL DISPENSING DEVICE

[76] Inventors: Charles R. Fegley, 1606 Frush Valley Road, Laureldale, Pa. 19605; Werner F. Esseluhn, 12 Larchwood Road, Wyomissing, Pa. 19610

[ * ] Notice: The portion of the term of this patent subsequent to Apr. 23, 1991, has been disclaimed.

[22] Filed: Dec. 6, 1974

[21] Appl. No.: 530,131

[52] U.S. Cl. ..... 222/5; 222/83.5; 222/162; 109/31

[51] Int. Cl.[2] ..... B65D 83/14; G08B 15/02

[58] Field of Search ..... 222/3, 5, 162, 83.5; 109/20, 31, 34, 32

[56] References Cited

UNITED STATES PATENTS 3,653,342 4/1972 Chilton ..... 109/31

3,806,000 4/1974 Fegley ..... 222/402.14 X

*Primary Examiner*—Robert B, Reeves
*Assistant Examiner*—Frederick R. Handren

[57] ABSTRACT

A chemical dispensing anti-burglary device is disclosed in which a chemical such as tear gas is discharged into the area to be protected when an intruder opens a door or forces open a door to enter a private or unauthorized area with which the device is associated. The anti-burglary device employs a spring biased actuating member moving a pressurized container to discharge a chemical irritant. A mechanical trigger for releasably retaining the biased actuating member in cocked position and for triggering the device and a lock mechanism to place the device in a non-triggerable condition are described. A combination for using the device with a door locking bolt and bolt latch plate is also shown.

10 Claims, 16 Drawing Figures

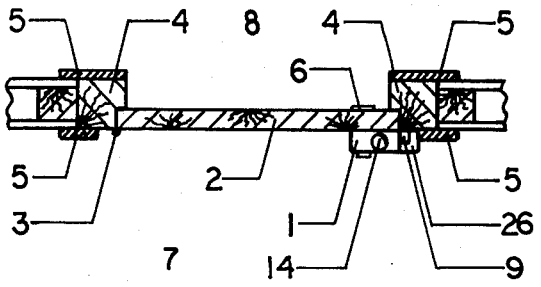
FIGURE 2,
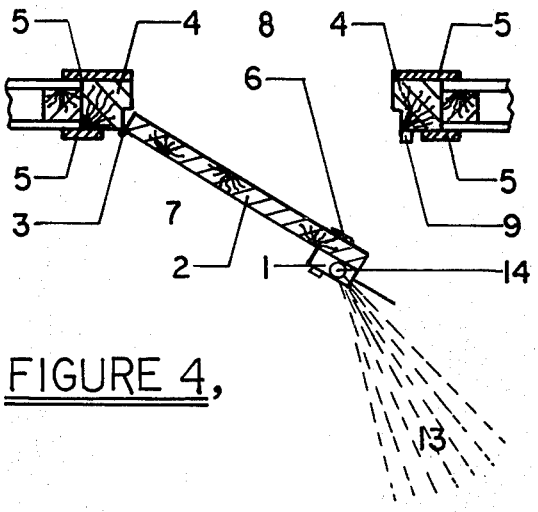
FIGURE 4,
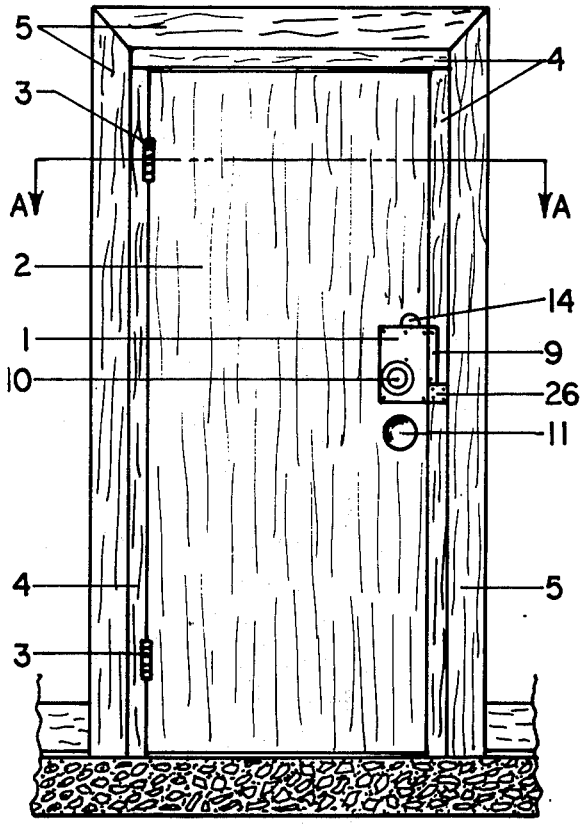
FIGURE 1
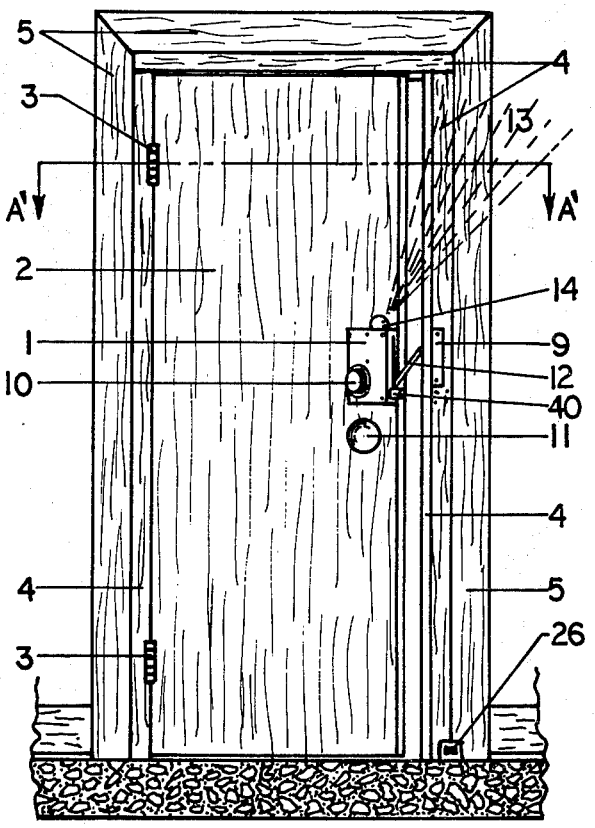
FIGURE 3

FIGURE 16
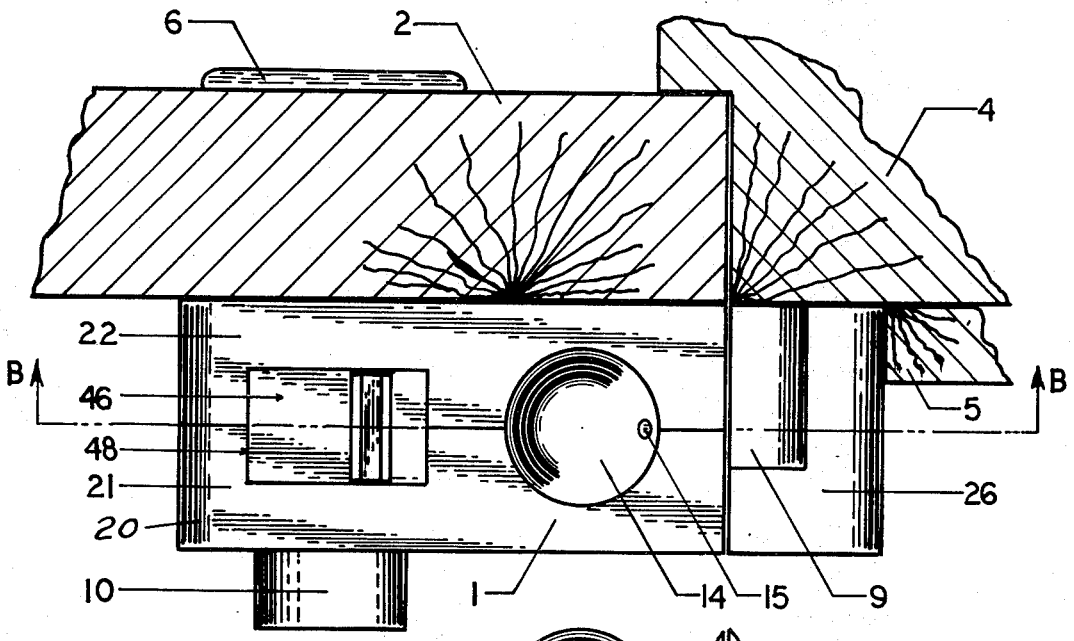
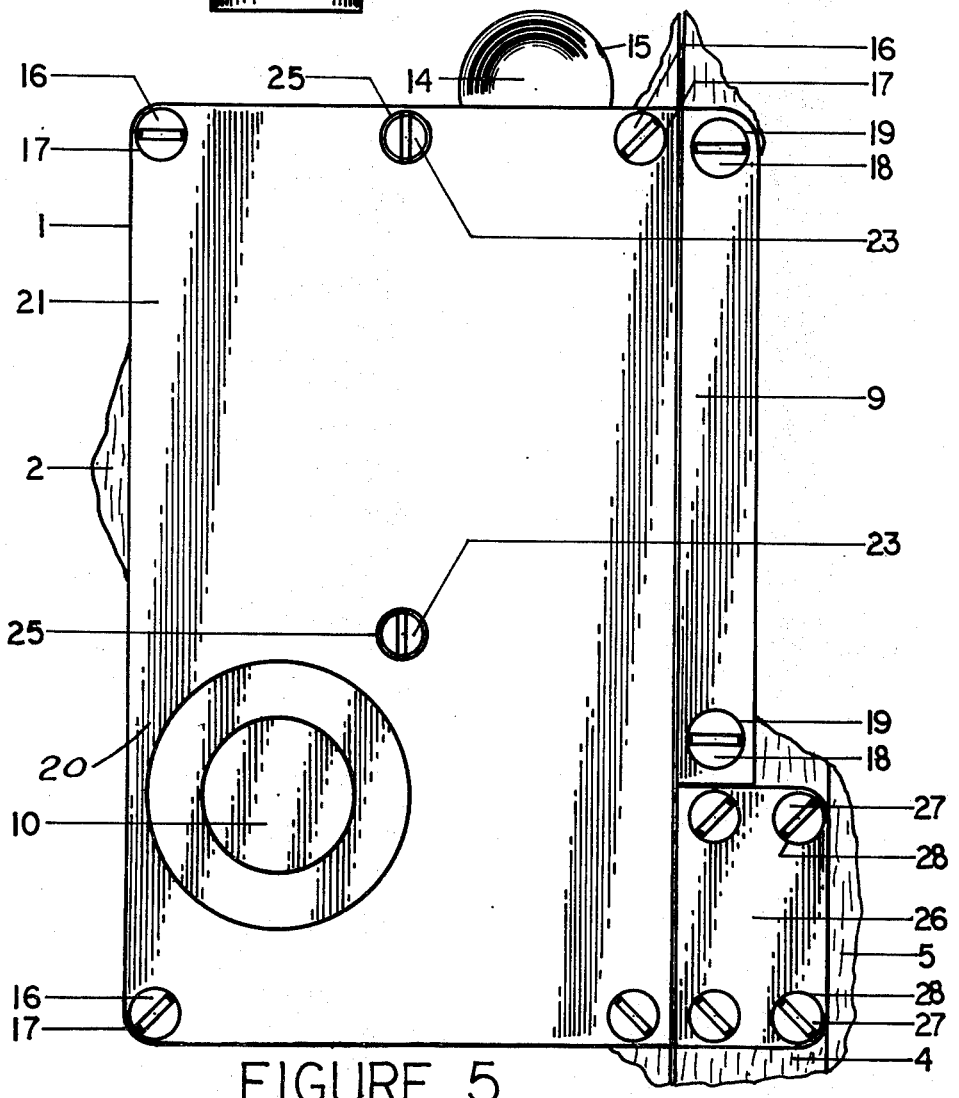
FIGURE 5

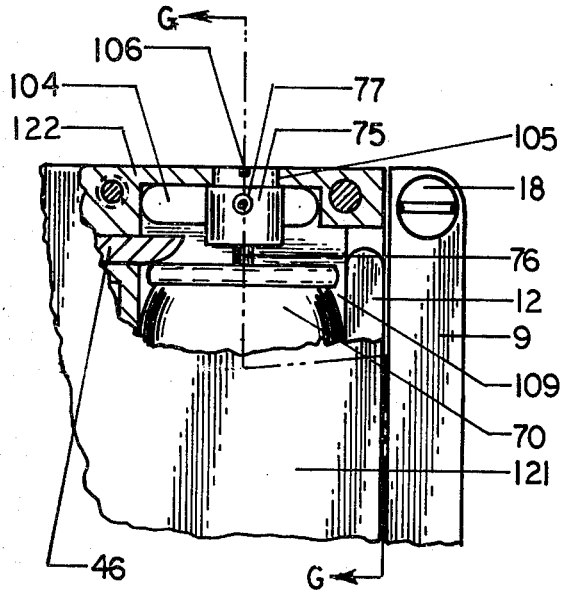
FIGURE 14
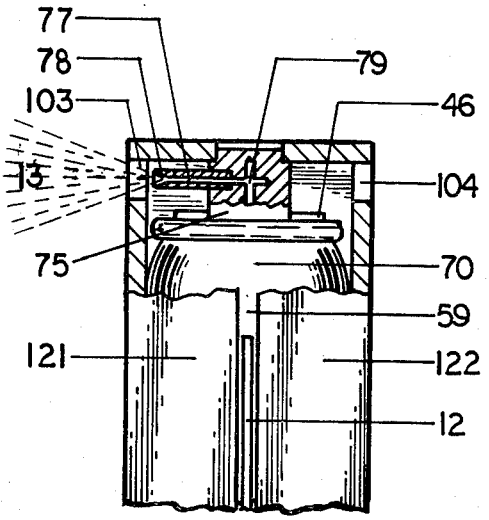
FIGURE 15
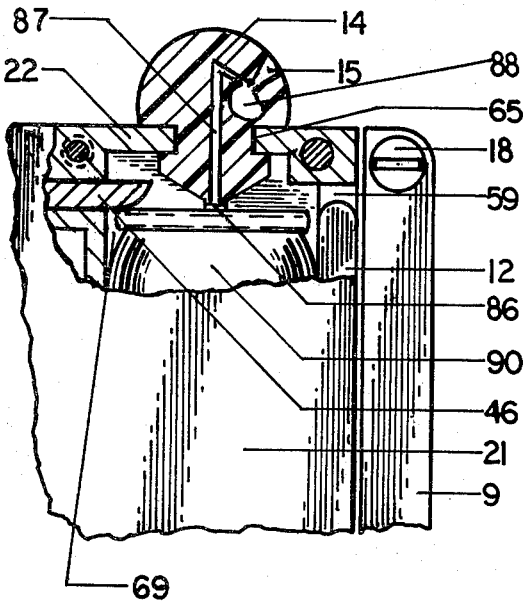
FIGURE 12,
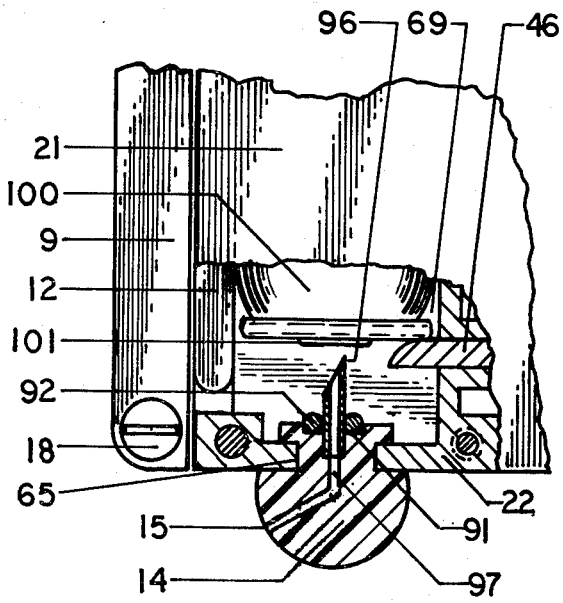
FIGURE 13,

ANTI-BURGLARY CHEMICAL DISPENSING DEVICE

BACKGROUND OF THE INVENTION

The invention relates generally to an anti-burglary device and more particularly to an anti-burglary device which dispenses a chemical such as tear gas from a pressurized container, one type of which is an aerosol container, into a protected area upon actuation by an unauthorized person, causing the protected area to be flooded with a chemical irritant and forcing evacuation of the protected area by the intruder; but the invention is not limited to the use of the aerosol type container.

Chemical weapons have been known in the art for many years. One type of chemical weapon is the conventional tear gas grenade in which the firing member is generally triggered manually and said grenade is manually hurled at a target area, causing the target area to be flooded with the chemical irritant.

In another type of chemical weapon, the chemical irritant is stored under pressure in an aerosol type container. The firing member is again generally triggered manually and the chemical irritant in the form of a spray is manually directed at a target.

A third type of chemical anti-burglary device discharges an explosive tear gas shell the area but this type is both dangerous and very limited as to the amount of tear gas which is discharged into the area to be protected.

Thus what is needed is an anti-burglary device in the form of a chemical dispenser which can be actuated by a relatively small amount of mechanical force even though the chemical weapon employs a relatively heavy spring biased actuating member for actuating the pressurized chemical container against the entry section of the passageway with sufficient force to release the chemical from said container but which anti-burglary device is positively secured against accidental release until triggered by an intruder and which will then release a sufficient volume of chemical into the protected area to force evacuation by the intruder.

SUMMARY OF THE INVENTION

The principle object of the present invention is to provide an anti-burglary device of the chemical dispensing type which may be triggered directly by a small amount of mechanical movement, and yet is positively secured against accidental release by a lock mechanism which locks the device and may also lock the door the device is mounted upon.

A further object of the invention is to provide an anti-burglary device of the chemical weapon type which is readily triggered by opening a door or other entry means by an intruder entering an unauthorized area.

Another object of the invention is to provide an improved means of spraying or discharging the chemical into the protected area in a minimum amount of time in order to force the intruder from the protected area and to prevent the intruder from re-entering the protected area for a reasonable amount of time.

A further object of the invention is to provide an anti-burglary device having means for reloading the device and resetting the biased actuating member of the weapon in its cocked position after the device has been triggered.

Another object of the present invention is to provide a directable emission of the chemical, such as by means of rotatably adjustable dispensing head, so that the invention might the located on a door, and yet, when the door is opened, direct the chemical into the protected area.

According to the principle aspect of the present invention there is provided an improved means for releasably retaining a spring biased actuating member and pressurized chemical container both slideably mounted in a cavity containing an entry section and passageway leading to a rotatably adjustable dispensing head A trigger element retains the slideably mounted spring biased actuating member in engagement, thereby also retaining pressurized chemical container in its ready position and requiring positive force for release. When the door or entry means associated with the device is opened by an unauthorized person or when the person enters the restricted area, the trigger element is removed from engagement with a latch plate which keeps the latter engaged, thereby allowing the trigger element to rotate and release the slideably mounted spring biased actuating member and permitting it and the container to be thrust toward the entry section of the passageway by the force of the spring associated with the actuating member thereby causing the container to discharge the chemical through the passageway and rotatable dispensing head into the protected area.

Since the trigger element, which serves to retain the pressurized chemical container in its cocked position, is rotatable; a relatively small amount of force is required to hold the trigger element in engagement with the biased actuating member even though a relatively strong spring is employed for forcing the biased actuating member into engagement with the container and the container into the entry section of the passageway. As a consequence, the latch plate holding the trigger element will not allow triggering of the chemical weapon. The resistance to movement of the trigger element on the latch plate is sufficiently low so as to be detected by an intruder.

In order to retain the spring biased actuating member safely in its cocked position against accidental release, a locking mechanism may be used in releasable engagement with a trigger element such that the locking mechanism retains the trigger element which is shaped so it will rotate from the pressure exerted on the trigger element by the spring biased actuating member. When the device is unlocked and an unauthorized person enters the protected area, the trigger element is released from the latch plate causing the spring biased actuating member and container to be thrust toward the entry section of the passageway, discharging the chemical irritant through the passageway and rotatable dispensing head into the protected area. When the device is locked, the trigger element is held in a non-releasable condition.

The means for locking and unlocking the device is a sliding bolt which may also be used with a bolt latch plate for locking the door or other entry means. The device, when used with a bolt latch plate, is locked into a non-releasable condition when the bolt is slideably disengaged from the latch plate and the door or other entry means is unbolted. A second means to place the device in a non-releasable condition is a contained slide which can prevent the container and spring biased actuating member from moving to a released condition by obstructing container movement within the container cavity.

The trigger element is shaped so as to exert only a small amount of force on the locking bolt. The locking bolt or contained slide nevertheless can retain the trigger element safely against accidental release from mechanical shock.

The anti-burglary device of the chemical weapon type of the present invention may be utilized in homes, factories, farms, office buildings by attaching the device to doors, windows, skylights, etc. and may be used in connection with vehicles such as boats, trucks, airplanes, etc. The device may also be employed for any other application wherein it is desired to prevent unauthorized persons from opening certain objects such as lockers, cabinets, chests, etc.

Once actuated, the spray cannot be turned off by the intruder and the entire amount of pressurized chemical will be discharged into the protected area making it impossible for the intruder to remain in the protected area without having protective equipment.

Other objects, aspects and advantages of the invention will become apparent from the following description taken in connection with the accompanying drawings.

BRIEF DESCRIPTION OF THE DRAWINGS

FIG. 1 is an elevational view of a wall of room having one embodiment of the anti-burglary chemical dispensing device of the present invention secured to the door and secured by means of a latch plate attached to the frame of the door.

FIG. 2 is a top plan sectional view taken along line A—A of FIG. 1.

FIG. 3 is an elevational similar to FIG. 1, but showing the door open and showing the device dispensing its chemical contents.

FIG. 4 is a top plan sectional view taken along line A′—A′ of FIG. 3.

FIG. 5 is a front elevational view of the anti-burglar chemical dispensing device.

FIG. 12 is a partial vertical section taken along line B—B of FIG. 16 similar to the section shown in FIG. 6 but showing a second embodiment of the device.

FIG. 13 is a partial vertical section taken along line B—B of FIG. 16 similar to the section shown in FIG. 6 but inverted and showing a third embodiment of the device.

FIG. 14 is a partial vertical sectioon taken along line B—B of FIG. 16 similar to the section shown in FIG. 6 but showing a fourth embodiment of the device.

FIG. 15 is a partial vertical section taken along line G—G of FIG. 14 but showing the fourth embodiment of the device in its released and dispensing condition.

FIG. 16 is a partial sectional top view taken along line A—A of FIG. 1.

DESCRIPTION OF THE PREFERRED EMBODIMENTS

Figure 7:
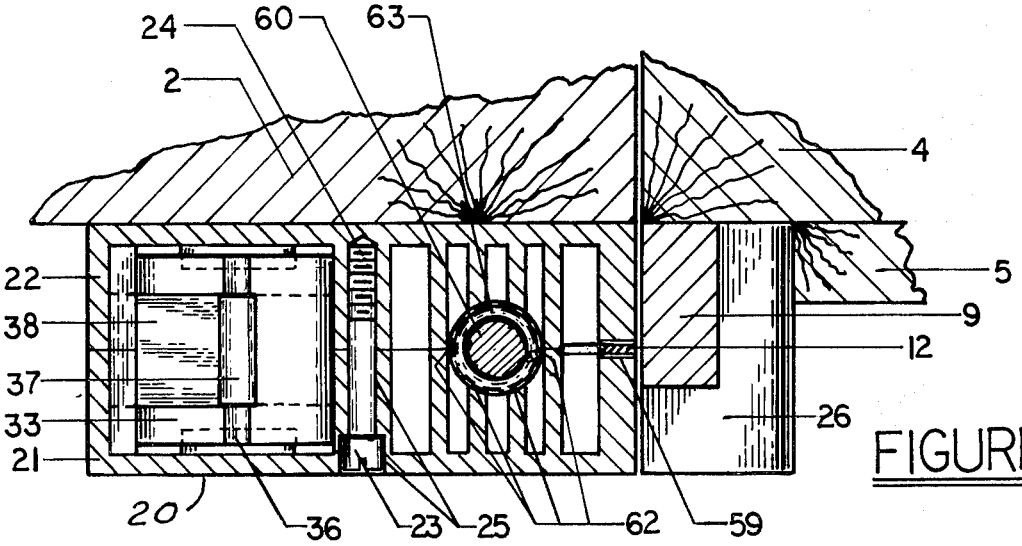
FIG. 7 is a horizontal sectional view taken along line C—C of FIG. 6 showing the trigger element held from releasing by the latch plate mounted on the door frame.

Referring now to the drawings in detail, wherein like reference characters designate like parts throughout the various views, there is shown in FIGS. 1–11, one form of the chemical dispensing device, called device hereafter, of the chemical weapon type according to the present invention, generally designated 1. In FIGS. 1 and 2, the device 1 is shown secured to a door 2 and positioned against a latch plate 9 mounted on door frame 4. Forceable opening of the door 2 by a burglar or intruder will move the device 1 away from the latch plate 9 and dispense a chemical 13 into the restricted area 7. The device 1 can be placed into a non-actuatable condition by locking device 1 with key cylinder 6, external to the restricted area or by the locking knob 10 mounted on the device.

Now referring to FIGS. 5, 6, 8 and 9; the device comprises of a pressurized chemical container 70 slideably mounted in a body member 20 shown as comprising of a right body half 21 and a left body half 22. The body halves 21 and 22 when assembled provide two similar sides for mounting the device 1 to the door 2 on either right or left sides of door 2 depending upon the location, left or right, of the door hinges 3 using mounting screws 16 through mounting holes 17.

Figure 6:
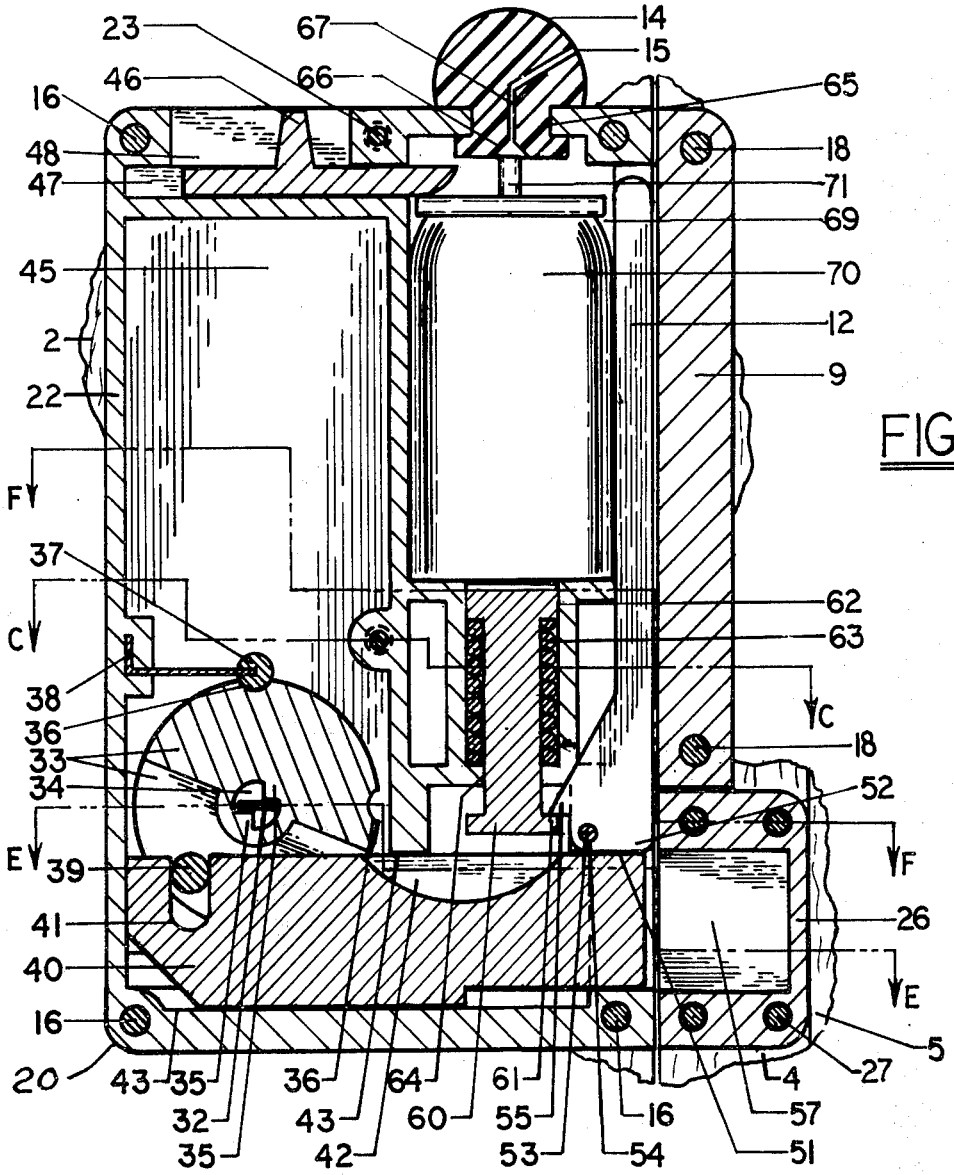
FIG. 6 is a vertical section taken along line B—B of FIG. 16.
Figure 9:
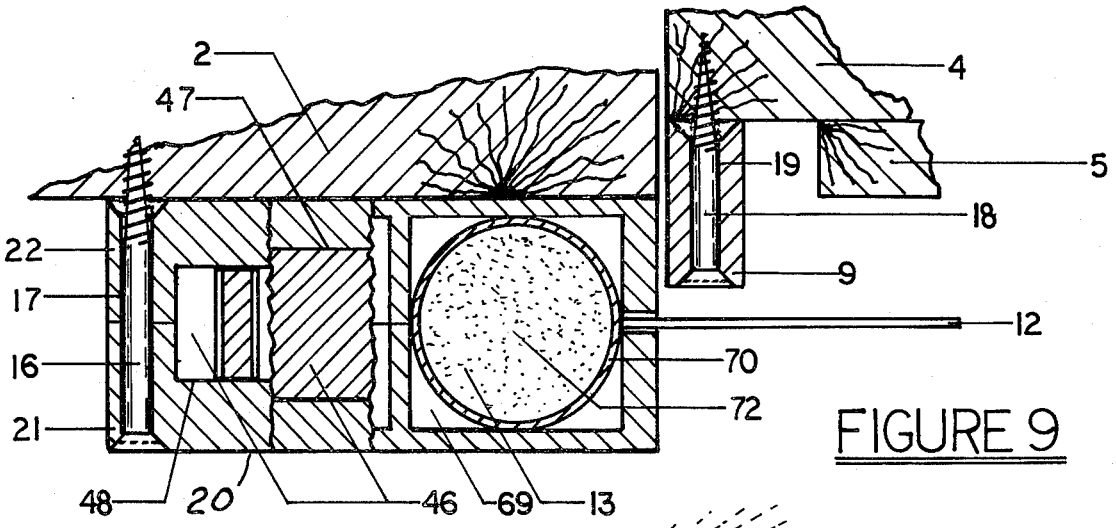
FIG. 9 is a fragmented sectional view similar to FIG. 7 but showing the trigger element released from the latch plate mounted on the door frame.

The device's complimentary latch plate 9 is mounted to the door frame 4 with screws 18 through mounting holes 19; as is the door locking bolt latch plate 26 mounted to the door frame 4 with mounting screws 27 through mounting holes 28. The body halves 21 and 22 of device 1 are shown assembled in FIGS. 5 and 7 with assembly screws 23 passing through the stepped assembly screw holes 25 in body half 21 to engage the threaded holes 24 of body half 22. The device is not limited to these means of assembly or attachment. It should also be noted that the device 1 will function without the locking bolt latch 26. By shortening the lock bolt 40 such that the slot 41 is made to engage crank pin 39 of the crank 33 in the position shown in FIG. 8 while the locking surface 51 of the locking bolt 40 remains as shown in FIG. 6. In this position, the device 1 will be in its locked position. By moving the locking bolt 40 to the left, the device 1 will be in its unlocked, actuation position.

The pressurized chemical container cavity 69 is formed when the symetrically opposite body halves 21 and 22 are joined together as shown in FIGS. 5, 7, 9, 10 and 11. Similarly formed and coaxial with said container cavity 69 are the spring cavity 62, spring biased actuating member cavity 64, the entry section 66 and passageway 67.

One type of pressurized chemical container 70 that can be used is of the aerosol type, but the invention is not limited to this type of container.

The pressurized chemical container 70 hereafter referred to as container 70, is slideably retained in cavity 69 such that spring biased actuating member 60 exerts force and thereby moves container 70 in direction 68 and causes the container dispensing spout 71 to seat into entry section 66 of passageway 67. The material used for dispensing spout 71 is relatively soft and therefore effects an adequate seal at the entry section 66 to retain the fluid at the pressure normally used in the container 70. The container 70 in the position illustrated in FIG. 8 is in its released position where the container dispensing spout 71 is seated into the section entry 66.

The container 70 in the position illustrated in FIG. 6 is in its cocked position where the spring 63 is compressed and the dispensing spout 71 is coaxial but loosely entered into the entry section 66. The container 70 and spring biased actuating member 60 are releasably restrained in a cocked position by a trigger element 12. The trigger element 12 is generally a flat member and includes a shaped latch portion 53, pivot hole 54, and a locking portion 52 and is best seen in FIGS. 6 and 8. The trigger element is rotatably mounted on a pivot pin 53 which is supported in holes located in body halves 21 and 22 and is slideably contained in slot 59 formed by the body halves 21 and 22. The shaped latch portion 52 engages the actuating member trigger rim 61 of the biased actuating member 60 when in the cocked position as shown in FIG. 6. The spring 63 urged actuating member 60 causes trigger element 12 to rotate clockwise by the action of latch portion 55 on rim 61 as shown in FIG. 6 around pivot pin 53 and therefore to be held against the latching plate 9 thus retaining the biased actuating member 60 and therefore container 70 in their cocked position.

Figure 10:
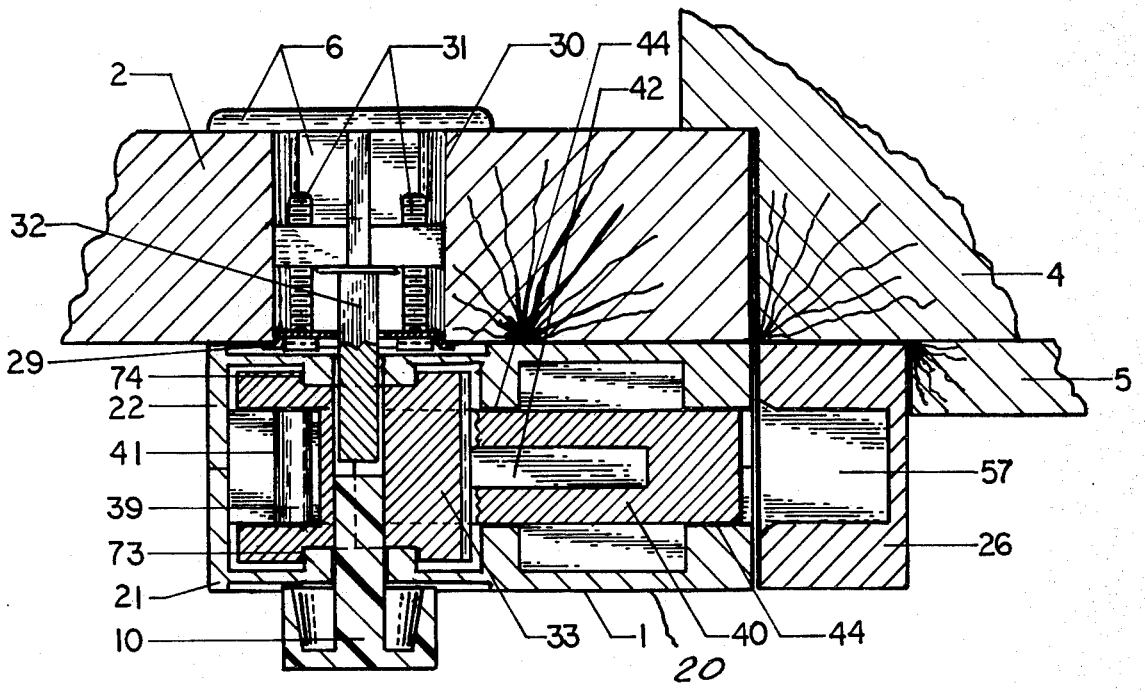
FIG. 10 is horizontal view taken along line E—E of FIG. 6 showing the locking bolt for door locking.

The biased actuating member 60 may be locked in its cocked position and the trigger element 12 held in its set position as shown in FIG. 6 by means of a crank-operated bolt 40 whose device locking surface 51 engages locking portion 52 of trigger element 12. The bolt 40 is generally rectangular cross-sectioned member which includes the crank pin slot 41 and trigger element clearance slot 42 and is best seen in FIGS. 6, 8 and 10. The crank-operated door bolt 40 is slideably contained in slot surfaces 43, 44 and 46 formed by the body halves 21 and 22.

Figure 8:
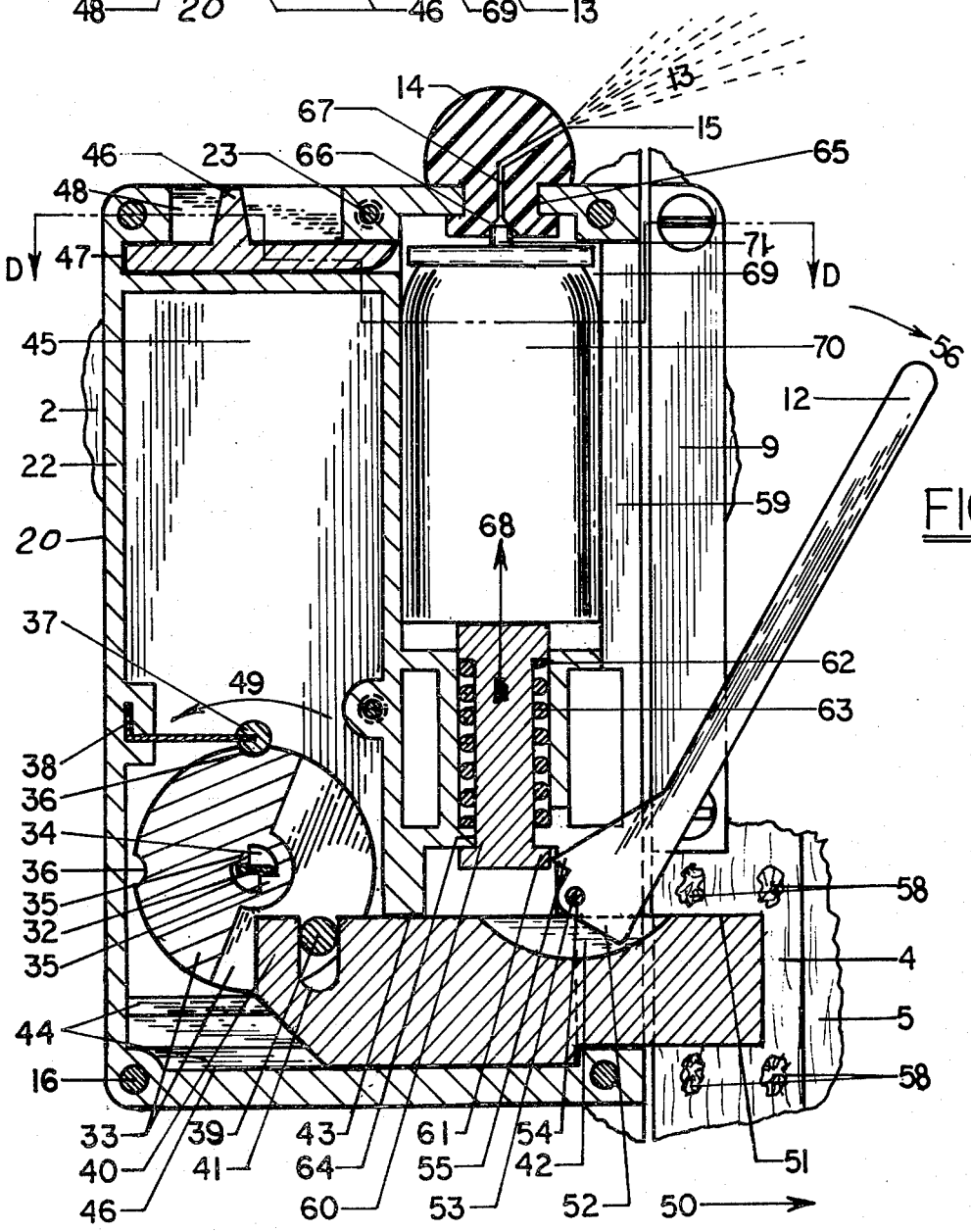
FIG. 8 is a vertical section similar to FIG. 6 but showing the anti-burglary device in its released position.

The crank-operated door bolt 40 is moved in direction 50 from the unlocked position shown in FIG. 6 to the locked position shown in FIG. 8 by operation of the rotary motion of the locking crank 33 and its crank pin 39 which is in slideable engagement with crank pin slot 41 when the crank is operated in direction 49 by lock mechanism 6 or locking knob 10. The door bolt 40 thus engages bolt latch plate 26 to lock the door and simutaneously place the trigger element 12 of device 1 into an actuatable or unlocked condition against latch plate 9.

In order to place the device 1 into an actuatable or unlocked condition against the latch plate 9, with the door 2 rotably mounted on hinges 3 attached to door frame 4 normally covered by aesthetic moldings 5 in a closed position is shown in FIGS. 1 and 2, the crank-operated bolt 40 must be slideably moved such that the device locking surfaces 51 of bolt 40 disengages from the trigger element locking portion 52 of trigger element 12 so that it is only held from rotatably releasing the spring biased actuating member 60 by latch plate 9. This unlocking is accomplished by rotation of the locking crank 33 shown in FIG. 6 in a counter-clockwise direction 49 for 90 degrees so that crank pin 39 causes the door bolt 40 to move in the direction 56 into engagement with the bolt latch plate 26. The locking portion 52 of the trigger element 12 being free to enter the trigger element clearance slot 42 thereby placing the trigger element 12 into an actuatable condition.

The locking crank 33 is rotatably mounted between internal projections 73 and 74 of body halves 21 and 22 in such a manner that it is fully contained and retained rotatably within the assembled device 1 as best seen in FIG. 5, 7, 10 and 11.

The crank 33 has two semi-circular detents 36, ninety degrees apart and parallel to the axis of the crank, with the detent bar 37 mounted on spring 38, which is supported between projecting portions of the body halves 21 and 22, limits the travel of the crank 33 to the bi-directional quarter turn movements of the lock blade 32 of the lock mechanism 6.

The locking crank 33 is rotated from the position shown in FIG. 6 to the position shown in FIG. 8 by inserting and rotating a key, not shown, 90° in cylinder lock assembly 6 shown in FIG. 10. The lock assembly's blade 32 located in the 90° rotation allowing hole 34 hereafter designated as hole 34 can, in its rotation against limit projection 35, rotate the crank 33, of which 34 and 35 are parts, 90° and yet permit a return of 90° by the lock assembly blade. This feature, common to many commercially available lock assemblies is necessary to permit removal of the key. Since most lock assemblies require a rotation in one direction to lock and the opposite to unlock from a key entry position and return to that position for key removal upon completion of the function desired it can readily be seen in FIG. 8 that the blade is now in position to perform the device locking, bolt unlocking sequence should the device 1 not be actuated by forced or unauthorized entry to the restricted area 7 as shown in FIGS. 3 and 4.

The lock assembly 6 is shown in FIG. 10 mounted on door 2 in hole 30 and is held in place by the lock mounting retainer plate 29 by use of lock assembly mounting screws 31. The device 1 is mounted on the door 2 with the device mounting screws 16 so that the locking cranks hole 34 will slide over the lock assembly's blade 32 and permit ease of rotation of the locking crank.

Locking knob 10 which is shaped to press fit into locking crank 33 hole 34 permits locking and unlocking of the device 1 from the restricted area 7. This feature is desirable when more than one door, window, etc. provide access to the restricted area 7 and exit from that area requires only use of one door.

A desirable feature of the device 1 is shown in FIGS. 5, 6, 8 and 9 and provides an additional device locking means. This second means provides additional safety should the device be placed into an actuatable condition when the device 1 is not engaged with latch plate 9 such as is shown in FIGS. 3 and 4 by the operation of the locking knob 10 or lock assembly. Safety slide latch 46, which is slideably mounted in cavity 47 formed by the body halves 21 and 22 and accessable for movement in opening 48 also formed by the body halves 21 and 22, can be used to lock the container 70 and spring 63 biased actuating member 60 as shown in FIGS. 6 and 16 into an unactuable condition even if the trigger element is released inadvertently. The safety slide latch 46 must, however, be in the position shown in FIGS. 8 and 9 in order for the device 1 to be functional for triggering by an intruder.

The lock assembly 6 is shown in FIGS. 2, 4, 5, and 10 is commercially available from manufacturers such as Chicago Lock Co., 4311 Belmont Avenue, Chicago, Illinois 60641 (Model 4031); Eaton Corp., Yale Lock and Hardward Division, Rye, N.Y. 10580.

Figure 11:
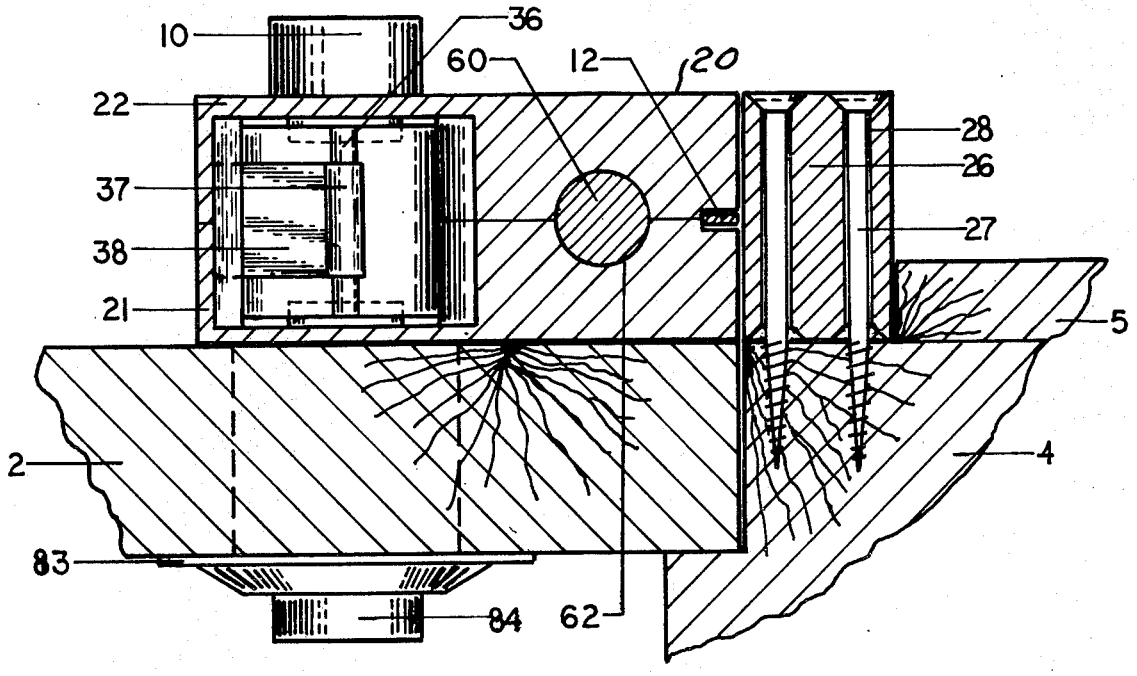
FIG. 11 is a horizontal sectional view taken along line F—F of FIG. 6 when the device is mounted on a door hinged different than that shown in FIGS. 1 through 10. A combination type lock assembly is also shown.

The device 1 is not limited to use of the lock assembly type shown in FIGS. 2, 4, 5 and 10 and may be used with other types of lock assemblies such as the combination lock assembly 83 and dial knob 84 shown in FIG. 11 which also shows an alternate mounting and assembly of device 1 on door 2. A pushbutton lock assembly such as manufactured by the Simplex Security Systems Co., 10 Front Street, Collinsville, Connecticut 06022 could also be effectively utilized to actuate and deactuate the device and to lock and unlock the bolt lock of device 1.

In the unlocked, actuatable condition shown by FIGS. 1, 2 and 8, the device protects the restricted area 7 from entry from accessible area 8 even though the door 2, generally secured to frame 4 by hinges 3 and the doors normal knob and the devices door locking bolt 40 and bolt latch plate 26 mounted on frame 4. Upon unauthorized entry to restricted area 7 by forcing open door 2, rotatably mounted on hinges 3, breaking off the device's bolt latch plate 26 as shown by the pulled out screw holes 58 of FIG. 8 and the bolt latch plate 26 position on the floor as shown in FIG. 3 the device 1 is actuated. As the door 2 rotatably moves into the restricted area 7 such as a home, apartment or office, etc. the device 1 slidably moves away from latch plate 9 as shown in FIGS. 3, 4, 8 and 9. As soon as the trigger element 12 slides from its engagement with latch plate 9, it is free to be rotated out of the spring biased actuating member 60 retaining position by the force of spring 63 slideably moving spring biased actuating member 60 in cavity 62 in direction 68, the rim 61 of the spring biased actuating member 60 slideably forcing the shaped trigger catch portion 55 of the trigger element 12 in such manner as to move the trigger element 12 out of slot 59 in direction 56. The container 70 being pushed by the spring biased actuating member 60 continues to move in direction 68 to seat container dispensing spout 71 firmly in the entry section 66 of passageway 67 and depress dispensing spout 71 into container 70 causing the pressurized chemical irritant 13 to be dispensed through the device 1 dispensing head 14, section entry 66, passageway 67 and dispensing orifice 15 into restricted area 7 as shown in FIGS. 3, 4 and 8.

After the device has been actuated in the manner described herein above, the body halves can be separated to replace the container 70, after restoring trigger element 12 and biased actuating member 60 to their cocked position as depicted in FIG. 6.

Yet another important feature is that the dispensing head 14 is rotatable in socket hole 65 through a large angle up to 360° so that the chemical irritant 13 may be directed from orifice 15 into any area relative to the triggering object such as when it is desired to protect the area after an unauthorized person moves a triggering object or entryway at a corner of the area to be protected.

Another important feature is that the spring 63 be of substantial force so the container projecting dispensing spout 71 will seat in the entry section 66 of passageway 67 with sufficient force to release the pressurized chemical through the passageway 67 and out the dispensing head 14.

When the restricted area 7 is not violated by unauthorized entry the device may be returned to a locked, unactuatable condition by operating the lock assembly 6 or the locking knob 10 so that the locking crank 33 is returned to the position shown in FIG. 6 causing locking bolt 40 to slide to engage portion 52 of the trigger element 12 with the device locking surface 51 of bolt 40 which locks trigger element 12 in place so that device 1 no longer can be actuated when slideably moved away from latch plate 9.

An important feature is that the locking bolt 40 serves as a substantial means of providing a dead latch type of door lock for securing the door against unauthorized entry into the protected area 7 in addition to serving as the normal means for actuating or deactuating the device. The door locking bolt 40 engages with bolt latch plate 26 in its bolt cavity 57 to perform the door locking and device actuation functions when operated by the lock assembly 6 or knob 10 operated crank 33. It is also important in this embodiment that the discharging means is comprised of a projecting dispensing spout 71 for actuating a valved pressurized container 70 wherein fluid discharge is caused when the projecting dispensing spout 71 is depressed. The body member 20 contains a fluid passageway 67 having a funnel shaped entry section 66 for engaging the projecting dispensing spout 71 and for forming a seal between the funnel shaped entry section 66 and the dispensing spout 71, thereby, permitting fluid flow through the dispensing spout 71 and the passageway 67 when the pressurized container 70 is moved toward the entry section 66.

In the embodiments described the chemical device 1 was illustrated showing a container 70 of the aerosol type with an projecting dispensing spout 71 well known in the trade, slideably mounted in a manner to discharge the chemical 13 into the entry section 66 of the passageway 67 when the device is fired. Alternately, a second embodiment shown in FIG. 12, the chemical dispensing device will also function with a container 90 of the aerosol type with a recessed valve, also well known in the trade, by providing a tubular member 86 depending from the dispensing head 14, thus extending passageway 87 to release the valve and providing an entry section engagable with the valve and providing a passageway for the chemical when the device is triggered.

When the chemical is dispensed through the passageway 87 to dispensing head 14 in semi-gaseous form typical of pressurized containers a loud audible noise is produced by the resonating chamber 88. The fluid is discharged from the pressurized container 90 into passageway 89, the chamber 88 and out orifice 15, then into the area to be protected. As the chemical 13 is being discharged, a whistle like sound will be produced as the chemical 13 is discharged, the pitch of which can be controlled by the shape and size of the chamber 88. Thereby issuing a warning sound in addition to filling the area with chemical 13 to protect the area where the device 1 is installed. This feature is not limited to this embodiment but can be incorporated in all embodiments.

A third embodiment of the device is shown in FIG. 13 wherein a pressurized container shown having puncturable seal rather than a valve. The device is shown in the inverted position to permit easier dispensing of the chemical from the sealed container 100. Upon triggering, the spring biased actuating member moves the container 100 and its puncturable seal 101 are thrust upon and are pierced by the pointed tubular member 96 which is an extension of the dispensing head 14. The container's puncturable seal is forced against the O-ring seal 92 which is seated in O-ring seat 91 of the dispensing head 14 to complete a pressurized seal necessary for the dispensing of the chemical through passageway 97 to dispensing head 14.

It is important in this embodiment that the discharging means comprises a shaped projecting forward section 96 of the body halves 21 and 22 to facilitate piercing the pierceable seal of the pressurized container 100. Upon movement of the pressurized container 100 toward the shaped projecting forward section 96, the shaped projecting forward section 96 pierces the pierceable seal of pressurized container 100. Continued movement of the pressurized container 100 compresses the O-ring 92 forming a seal between the pressurized container 100 and the retaining seat 91 whereby fluid is discharged through the pierced seal and the passageway 97.

A fourth embodiment is shown in FIGS. 14 and 15 in which a valved container 70 having a commercially available dispensing cap 75 is used. An extension tube 77 serves as an extension to passageway 79 so the chemical irritant may be directed from either side of the device depending on mounting. The body halves 121 and 122 contain apertures 103 and 104 to permit the chemical to be dispensed as shown in FIG. 15 which shows the device in the triggered or dispensing condition. The cap is restricted in the coaxial opening 105 formed by body halves 121 and 122 and contains screwdriver slot 106 so that the cap may be rotated to direct the chemical 13 through either apertures 103 or 104 in a number of positions only limited by the linear or circumferential length of the apertures 103 and 104. It is also important in this embodiment that the discharging means comprises a projecting dispensing cap 75 for actuating a valved pressurized container 70 wherein fluid discharge is caused when the projecting dispensing cap 75 is depressed. The body halves 121 and 122 contain apertures 103 and 104 in communication with orifice 78 of the dispensing cap 75 for fluid discharge therethrough. Upon movement of the pressurized container 70, the projecting cap 75 is moved toward the housing roof. Continued movement causes the projecting dispensing cap 75 to be depressed whereupon fluid is discharged through the projecting dispensing cap 75 and through aperture 103.

Although we have herein shown and described the invention in what we have conceived to be the most practical and preferred embodiments, it is recognized that departure may be made thereform within the scope of our invention, which is not to be limited to the details disclosed herein, but is to be accorded the full scope of the claims so as to embrace any and all equivalent structures and devices.

We claim:

1. A chemical dispensing anti-burglar device for use with a pressurized container, the device comprising: a body member; means for slideably supporting said pressurized container in said body member; a fluid passageway extending through said body member having an entry section; means for causing the discharge of fluid from said container into said entry section of said fluid passageway; a spring actuating member supported in said body member and arranged to actuate said discharging means upon movement of said slideably supported pressurized container when said biased actuating member is released; means for releasably retaining said biased actuating member in a cocked position; said retaining means including a trigger element; said trigger is element being mounted for movement between an actuation position and a release position; said trigger element in said actuation position being in engagement with said biased actuating member to retain said biased actuating member in a cocked position; said trigger element in said release position allowing said biased actuating member to actuate said discharging through movement of said pressurized container whereby the means for discharging fluid causes discharge; means for locking said trigger element in engagement with said biased actuating member; said locking means being mounted for movement between a locked position and a release position; said locking means in said locked position securing said trigger element in engagement with said biased actuating member; and said locking means in its release position permitting said trigger element to move to its release position; and means external to said body member for releasably retaining said trigger element in its actuation position; said external retaining means including a latch plate mounted separate from said body member; said body member being movable between a first position in which said external retaining means retains said trigger element in its actuation position; and a second position in which said external retaining means allows said trigger element to move to its release position.

2. The chemical dispensing anti-burglar device of claim 1 in which the pressurized container comprises a pierceable section, means to provide a seal between the pierceable section and said entry section, and means for puncturing said pierceable section, whereby fluid may be discharged.

3. The chemical dispensing anti-burglar device of claim 3 in which said means for puncturing comprises a projecting spout depending from said body member.

4. The device of claim 1 in which the locking means comprises a combination lock assembly.

5. The device of claim 1 in which the locking means comprises a cylinder lock assembly.

6. The chemical dispensing anti-burglar device of claim 1 wherein said pressurized container includes a dispensing valve actuated to permit fluid discharge therethrough upon depression thereof, said valve being actuated to said release position through movement of spring biased actuating member acting to move said slideably mounted pressurized container to cause depressioon of said valve, thus causing discharge.

7. The chemical dispensing anti-burglar device of claim 6 wherein said valve pressurized container contains a projecting dispensing spout, said dispensing spout discharging fluid upon depression thereof, said entry section being funnel shaped for receiving said projecting spout on said container.

8. The chemical dispensing anti-burglar device of claim 6 wherein said valve pressurized container includes a recessed valve, said body member includes a projection in said entry section extending beyond said entry section toward said container to engage said recessed valve, said recessed valve actuated upon depression thereof to emit fluid.

9. The chemical dispensing anti-burglar device of claim 1 wherein said locking means includes a lock bolt and a locking bolt latch; said locking bolt being mounted for movement between an extended position and a retracted position; said locking bolt in said extended position to extend beyond said body member to engage said locking bolt latch mounted separate from said body member; and said locking bolt in said retracted position moved within said body member and withdrawn from engagement with said locking bolt latch.

10. A chemical dispensing anti-burglar device for use with a pressurized container including a projecting dispensing cap actuated to emit fluid discharge therethrough upon depression thereof, the device comprising: a body member; means for slideably supporting said pressurized container in said body member; an aperture in said body member in communication with said projecting dispensing cap; means for restricting movement of said projecting dispensing cap; a spring biased actuating member supported in said body member and arranged to actuate said projecting dispensing cap upon movement of said slideably supported pressurized container when said biased actuating member is released; means for releasably retaining said biased actuating member in a cocked position; said retaining means including a trigger element; said trigger element being mounted for movement between an actuation positon and a release position; said trigger element in said actuation position being in engagement with said biased actuating member to retain said biased actuating member in a cocked position; said trigger element in said release position allowing said biased actuating member to actuate said dispensing cap through movement of said presssurized container whereby fluid is discharged through said dispensing cap and aperture; means for locking said trigger element in engagement with said biased actuating member; said locking means being mounted for movement between a locked position and a release position; said locking means in said locked position securing said trigger element in engagement with said biased actuating member; and said locking means in its release position permitting the trigger element to move to its release position; and means external to the body member for releasably retaining the trigger element in its actuation position; said external retaining means including a latch plate mounted separate from the body member; the body member being movable between a first position in which the external retaining means retains the trigger element in its actuation position; and a second position in which the external retaining means allows the trigger element to move to its release position.

* * * * *